United States Patent [19]

Schlick

[11] Patent Number: 4,693,756

[45] Date of Patent: Sep. 15, 1987

[54] METHOD AND RETORT FOR THE REMOVAL OF CARBONIZABLE COATINGS FROM THE SURFACES OF METAL OBJECTS

[75] Inventor: Horst D. Schlick, Metelen, Fed. Rep. of Germany

[73] Assignee: Schlick Roto-Jet Maschinenbau GmbH, Metelen, Fed. Rep. of Germany

[21] Appl. No.: 749,004

[22] Filed: Jun. 26, 1985

[30] Foreign Application Priority Data

Jul. 17, 1984 [DE] Fed. Rep. of Germany ..... 3426242

[51] Int. Cl.[4] ..... B08B 7/00; B24B 1/00; F23J 00/00

[52] U.S. Cl. ..... 134/7; 134/20; 134/38; 134/39; 51/319; 51/320; 51/322; 431/3

[58] Field of Search ..... 51/319, 320, 322; 134/7, 20, 38, 39; 431/3

[56] References Cited

U.S. PATENT DOCUMENTS

| | | | |
|---|---|---|---|
| 2,536,843 | 1/1951 | Dye | 134/7 X |
| 2,978,378 | 4/1961 | Hult et al. | 134/7 X |
| 3,824,739 | 7/1974 | Moret et al. | 51/322 X |
| 3,945,155 | 3/1976 | Lebaèrt | 134/7 X |
| 4,297,147 | 10/1981 | Nunciato et al. | 134/7 |

FOREIGN PATENT DOCUMENTS

| | | | |
|---|---|---|---|
| 2850641 | 5/1974 | Fed. Rep. of Germany | 51/319 |

*Primary Examiner*—Andrew H. Metz
*Assistant Examiner*—William G. Wright
*Attorney, Agent, or Firm*—Felfe & Lynch

[57] ABSTRACT

A method for the removal of carbonizable, adherent coatings from the surfaces of metal parts, in which the metal parts are baked or pyrolyzed in the course of the method. The metal parts are brought to the carbonizing temperature in a substantially closed retort. Without leaving the retort, the adherent, carbonized coating is blasted off by means of heated blasting medium as the carbonization proceeds or after it ends. The heating of the metal parts is performed in a fluidized bed within the retort. The medium of the fluidized bed is simultaneously the blasting medium.

9 Claims, 4 Drawing Figures

METHOD AND RETORT FOR THE REMOVAL OF CARBONIZABLE COATINGS FROM THE SURFACES OF METAL OBJECTS

This invention relates to a method for the removal of carbonizable coatings adhering to the surfaces of metal objects and, more particularly, to a method for the removal of such coatings in which the metal objects are subjected to low-temperature carbonization or pyrolysis.

As used herein and in the claims, the term metal includes one or more metals or metal alloys or metal compounds.

In many technical fields, metal parts become very dirty in the course of operations. For example, the hangers or the so-called "body skits" become almost entirely encased in lacquer in the painting of automobile body parts. These parts, however, must from time to time be completely stripped of the adhering lacquer, because otherwise they will not be able to conduct current for the electrolytic painting operation. Since lacquer removal with a solvent has not been practicable on account of the cost and environmental pollution involved, these parts are cleaned in a retort whose bottom is covered by a heated fluidized bed. Sand is commonly used as the material for this cleaning operation. The bottom of the retort is permeable to air, so that air from the compressed-air lines or from a blower can be blown into the sand bed. When the fluidized bed is heated at a temperature of 400° to 450° C., the metal parts are heated very rapidly and the organic lacquer coatings are carbonized. This stripping requires about 20 to 40 minutes as a rule.

In the known apparatus, since the metal surface must be perfectly free also of the carbonized residues, another treatment is necessary. The metal parts to be cleaned are removed from the retort and then cleaned in a sandblasting machine to the bare metal surface until all of the carbonized residues have been removed.

It is also known to place the parts removed from the hot fluidized bed on a shaking table so as to shake off coarse pieces of carbonized material or jostle them off one another. The fine debris is then removed by sandblasting, and in some cases these steps are partially automated outside of the retort.

On account of the relatively soft consistency of unhardened layers of lacquer on the metal parts it is not possible to clean them directly by the sandblasting method. The surface layers are still rather rubbery, so that the particles striking them produce no effect. Similar difficulties are to be observed in the case of adherent coatings of soft consistency, e.g., in the case of metal surfaces coated with foam plastic, in the case of metal parts coated with vulcanized rubber, or in the case of strands of cable covered with an elastomer.

The problem accordingly is to improve the carbonizing and pyrolysis process described above such that the working time will be shortened and that it will no longer be necessary to remove the metal parts from the pyrolysis retort in order to achieve immaculately cleaned metal surfaces.

In accordance with the invention, this problem is solved, in a method for the removal of carbonizable, adherent coatings, by heating the metal parts to the low-temperature carbonizing temperature in a substantially closed retort, and, without leaving the retort, blasting away the adherent, carbonized coating during or after the carbonization by means of heated blasting medium.

The above-stated principle of the invention makes use of a novel technique, including the use of a heated blasting medium. The temperature of the blasting medium should preferably be in the range of the carbonizing temperature, but in any case so high that the temperature required for the carbonizing does not diminish within the retort. It is furthermore also possible to heat the blasting medium above the carbonizing temperature. In this case, the blasting medium itself becomes a heating medium which yields its temperature to the retort atmosphere and furthermore, in colliding with the coating, it yields heat directly to it, resulting in a progressive pyrolyzation and carbonization.

Actually it has been observed in experimental operations that it is not necessary to wait for the entire coating to be carbonized through and through; the particularly advantageous effect of the invention is that the carbonizing progresses and the carbonized layer is stripped away continuously by the heated blasting medium.

While in the case of the known fluidized bed a large part of the energy has to be used for the purpose of heating and carbonizing the inner layers as well, this energy is not required in the present case. The freshly carbonized material is immediately stripped away and the still uncarbonized but soft material is fully exposed to the heat. By this principle it is possible to achieve very fast action, and the process can be performed in an enclosed retort.

At the same time it is possible also to perform the heating in a fluidized bed that is situated in the bottom portion of the retort and into which the metal parts to be cleaned can be lowered by a hoist. After removal from the hot fluidized bed, the blasting operation can immediately begin. By additional air circulation means and the like, the transport of heat within the retort can be further improved. At the same time it is an important advantage that the medium of the fluidized bed can at the same time also be the blasting medium. If, for example, sand or steel grits are used, as they ordinarily are used as a blasting medium, the working and regenerating times can be reduced to a minimum.

The grain size and nature of the blasting medium are selected in accordance with the work to be performed. Especially in the stripping of cable scrap it is advantageous that the blasting medium be of the metal of which the cable consists. The material can then be removed as a whole from time to time and be electrolytically refined.

A retort for the practice of the process has in the jet area slots to admit the blasting medium streams produced by a spinner. Spinners which can produce a high propulsive force are commonly used for this purpose. However, it is possible to use hand-operated compressed-air sandblasting guns. In addition, the retort can contain in its lower portion a fluidized bed such as the kind used heretofore in such retorts. In this manner, a bath of solids is produced in a known manner, into which the metal parts can be immersed. By means of the appropriately hot bed fluidizing medium (preferably air) the metal parts are very rapidly heated, simultaneously with the lacquer and other such coatings. At the same time, by the controlled mixture of inert gases or the use of excess oxygen a controlled combustion of the excess lacquer can be performed, the combustion heat being also available for the heating of the retort atmosphere.

The retort is preferably equipped with a hoist which also permits the metal parts or a basket containing the metal parts to be rotated in the stream of the blasting medium. It is furthermore possible to perform a continuous pass-through operation, especially for long pipes and the like, if the retort is provided with heat-confining pass-through gates such as those used in closed sandblasting booths.

For a better understanding of the invention, together with other and further objects thereof, reference is made to the following description, taken in connection with the accompanying drawings, and its scope will be pointed out in the appended claims.

In accordance with the invention, a method for the removal of carbonizable, adherent coatings from the surfaces of metal objects, in which the coatings on the metal objects are carbonized or pyrolyzed in the course of the method, comprises bringing one or more metal objects having one or more carbonizable, adherent coatings on one or more surfaces thereof in a substantially closed retort to the carbonizing temperature. The method includes, without the one or more metal objects leaving the retort, utilizing a heated blasting medium to blast off the one or more adherent, carbonized coatings at least after the beginning of the carbonization.

Also in accordance with the invention, a retort for use in the method of the invention comprises a body having a wall having slots for admitting a stream of blasting medium.

Referring now to the drawings.

Figure 1:
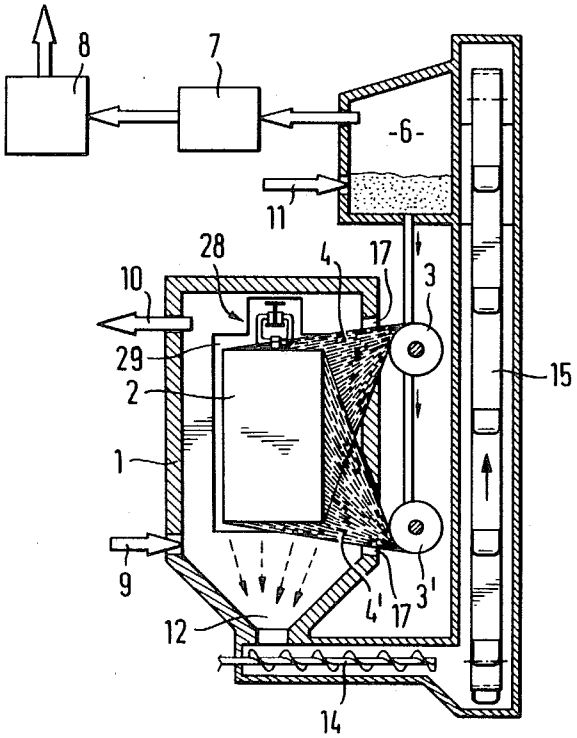
FIG. 1 is a diagrammatic sectional representation of a retort suitable for the method in accordance with the invention with other units coupled to it.

FIG. 1 represents diagrammatically a substantially closed retort 1 which has a capacity adapted to the purpose for which it is used, and into which the materials to be treated can be passed continuously or discontinuously through ports known in themselves. In the present case a so-called sandblasting basket 2 preferably is provided, which preferably is situated approximately in the central part of the retort 1, carried, for example, by a hoist which is mounted in the top portion of the retort (not represented in FIG. 1).

By means of two sandblasting spinners 3, 3', of known type, a blasting medium preferably is directed against the sandblasting basket 2 in two overlapping streams 4 and 4'. The blasting medium preferably is fed to the spinners 3 by a cleaning device with a supply hopper 6. The blasting medium preferably is heated in the supply hopper. For this purpose heat energy is supplied to the hopper 6 as indicated by the arrow 11. The heating can be performed indirectly by hot combustion gases or also by heating radiators or wires disposed in the hopper.

The retort can also be supplied with thermal energy by infrared radiators, for example, or by heated air (indicated by the arrow 9). It is important that the metal parts which are soiled or provided with strongly-adhering coatings be situated in a substantially closed retort and be able to be raised preferably to a low carbonizing temperature, which in the case of lacquer residues is around 450° C. By the temperature in the retort, the adherent lacquer residue coatings are carbonized from the outside in, the exhaust gases being removed by an appropriate exhaust means (arrow 10) and burned off in an afterburner 7 together with other low-temperature carbonization gases. The thermal energy thereby produced is recycled to the process as indicated by the arrows 9 and 11. Additional heating circuits are, of course, also possible, as already indicated.

As the carbonization progresses, the jets of blasting medium remove the embrittled coating layer by layer. The used blasting medium drops into the hopper-shaped bottom portion 12 of the retort 1 where it is removed in the still-hot condition by means of a screw conveyor 14 and carried by a bucket mechanism 15 into the container 6 for cleaning. The unburned coating particles, separated by means of centrifugal air separators, for example, can be burned in a furnace 7 serving as an oxygen-fed afterburner. The energy thus obtained can be returned to the circuit.

Through a filter system 8 and with after-cooling, if desired, the air can be rendered inert and be released to the atmosphere.

Figure 2:
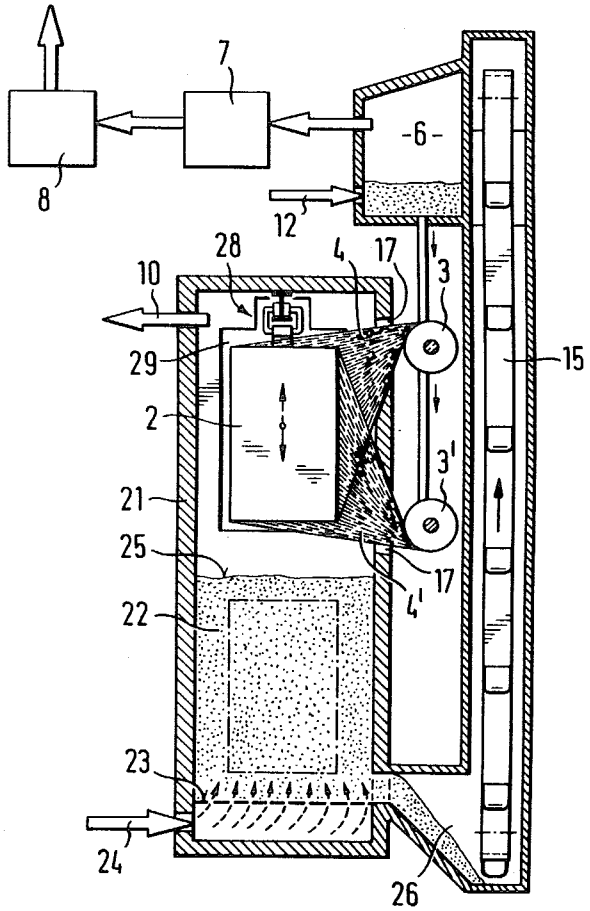
FIG. 2 is a diagrammatic sectional representation of a retort with a fluidizable bed in the bottom, and additional output units as in FIG. 1.

FIG. 2 shows how the principle of the invention illustrated in FIG. 1 is extended to a larger retort 21 which has, in addition to an upper portion configured like the blasting station in FIG. 1, a bottom portion in which a fluidized bed 22 is produced. Through a perforated bottom 23, heated air or a gaseous medium of a lower oxygen content than air is blown, producing a fluidized bed 22 in a known manner. The fluidized bed has its boundary at 25. It preferably comprises blasting medium which has a temperature corresponding to the carbonizing temperature required for the task at hand. The material used for the fluidized bed preferably is the same as that used for the blasting, for example, sand or aluminum granules of a size between 0.1 and 1 mm. Granulated steel or copper can also be used. In the present case, the material to be cleaned, for example plastic-covered cable scraps, is suspended in a blasting basket or hung piece by piece and exposed to the streams 4 and 4' which are produced by two spinners 3 and 3'. The debris drops into the fluidized bed where it is cleaned by carbonization and the flow of air through it. There is an exhaust at 20. In the top portion of the retort 21 there is a hoist whereby the target to be blasted—a blasting basket for example—can be lowered into the fluidized bed, which easily accommodates the target. After a certain time of stay in the fluidized bed, the adhering coating preferably is heated to such an extent that it becomes carbonized. Then the target preferably is removed from the fluidized bed and brought into the blasting area. There the adhering, carbonized residues are immediately stripped away by the hot stream of blasting medium.

The contaminated and possible overflowing blasting medium plus carbonized particles of increasing bulk preferably is carried out through a passage 26 and, by means of a bucket elevator 15, it preferably is carried back into a combination cleaning and storage hopper 6. Here, as in the method described in connection with FIG. 1, an afterburning, filtering and additional heating preferably is performed, after which the blasting medium preferably is recycled to the sandblasting spinners 3 and 3'.

In the embodiment shown in FIG. 2, accordingly, there is an interaction between the fluidized bed whereby metal parts are heated, and the heated blasting medium, whereby carbonized matter is removed from the surface of these metal parts. The energy required for this purpose is preferably obtained directly from the afterburning of the carbonizable residues. The blasting medium itself can be recycled without great heat losses and can also be cleaned in the station 6. Suitable for the cleaning are common air separators which can be operated on hot air or an inertiated medium.

Figure 3:
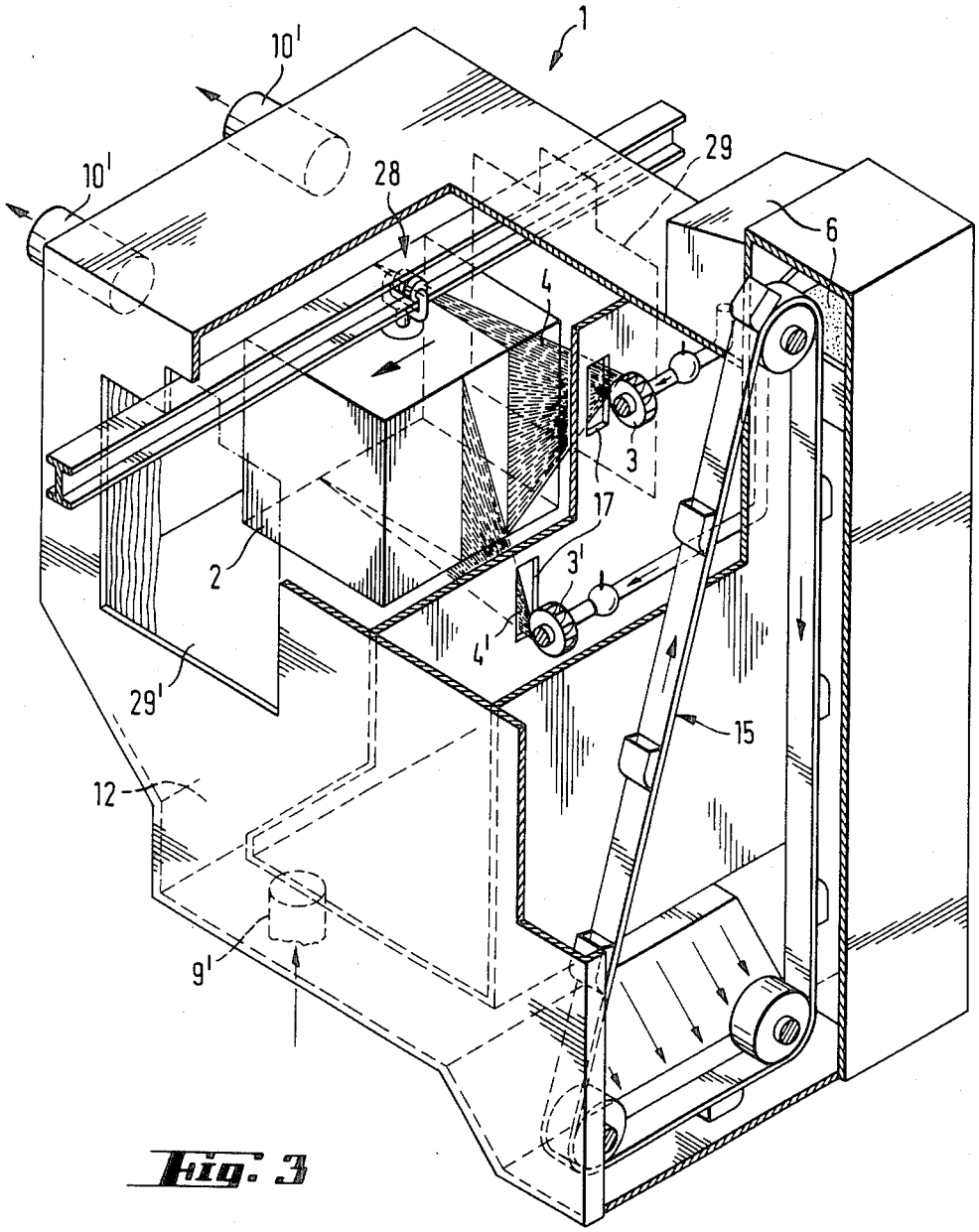
FIG. 3 is a fragmentary perspective view of a retort corresponding to the FIG. 1 retort.

A detailed view of the retort for the practice of the method is represented in FIG. 3.

The retort 1 preferably has a box-like casing which is provided with a layer of thermal insulation. In the top portion of the casing there preferably is provided a hoist 28 on which a sandblasting basket 2 or single metal parts can be suspended. The objects can be carried in and out through gates 29 and 29' provided with heat-confining curtains. In the upper portion of the retort 1 there preferably are provided two slotted portions 17 (also represented in FIG. 1) through which the streams 4 and 4' of blasting medium, which originate from the two spinners 3 and 3', can enter the interior of the blasting chamber. The blasting medium preferably is fed from the supply chamber 6 through chutes into the spinners 3 and 3' in the previously heated state. The dirty blasting medium drops, after contact with the metal pieces to be cleaned, into the bottom region of the retort 1 where it preferably is picked up by a heat-resistant bucket conveyor and transported back upward into the supply chamber 6. For this purpose the bottom preferably tapers hopperwise toward the pickup area of the bucket conveyor. At 9' can be seen an inlet for hot air whereby the atmosphere of the retort 1 can be heated. Two exhaust pipes are represented at 10' for the hot exhaust air, which can be burned off.

FIGS. 1 and 3, which represent basically the same retort, serve only to explain the principle of the invention. Variations of this embodiment are, of course, possible.

Figure 4:
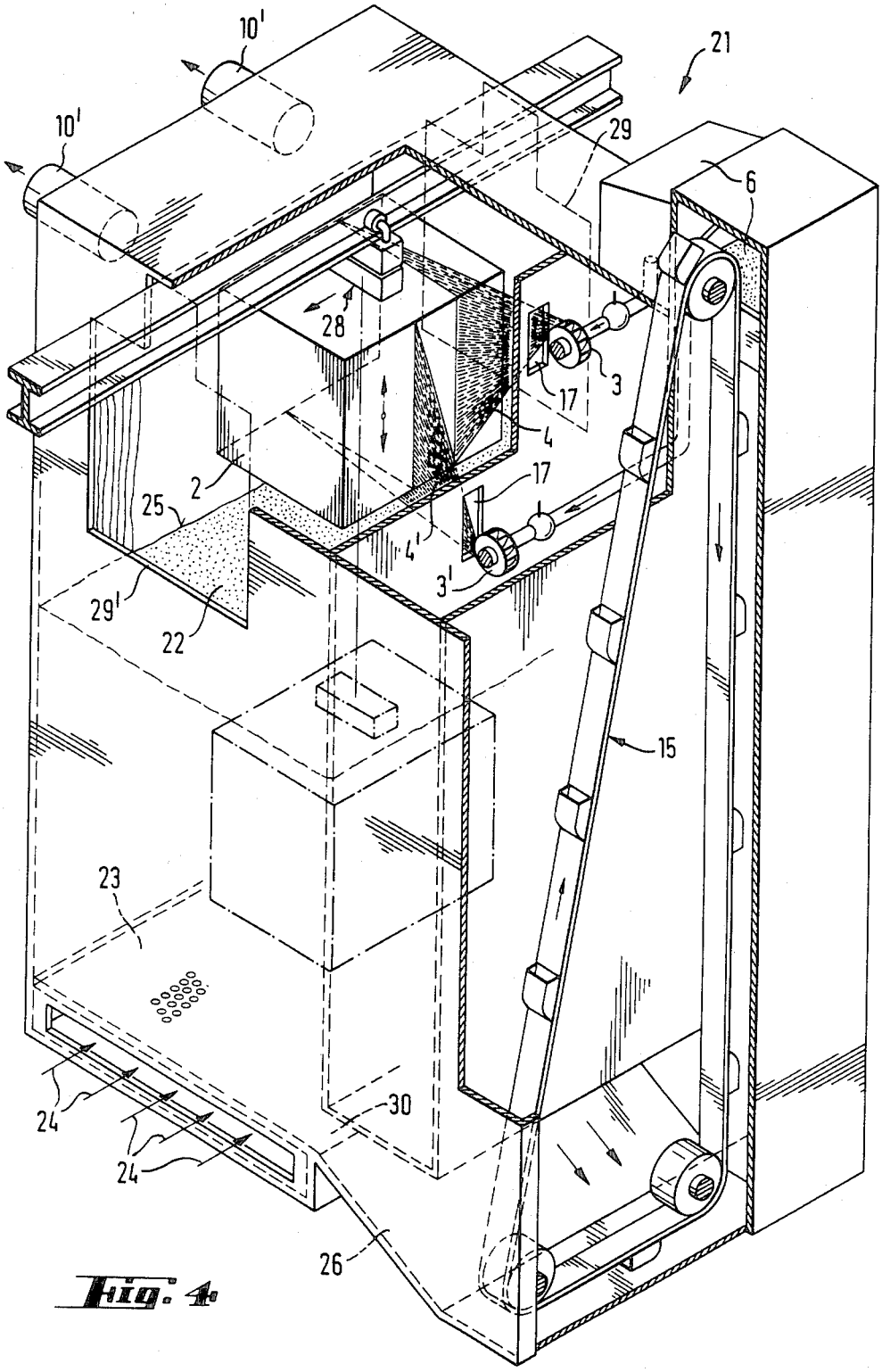
FIG. 4 is a detailed fragmentary perspective representation of a retort with a fluidizable bed in accordance with FIG. 2.

FIG. 4 is a detailed representation of an embodiment of a retort 21, in which a fluidized bed 22 is produced by means of injected air 24. The injected air, which can also be a largely oxygen-free inertiated medium, has a temperature which raises the material of the bed, which is simultaneously the blasting medium, to a carbonizing temperature as required. The carbonizing exhaust gases are withdrawn from the fluidized bed and removed through exhaust pipes 10' or delivered to an afterburner. In the upper portion of the retort 21 is a blasting station which in the present case again is provided with two spinners 3, 3', a technique being used which is similar to the one used in FIG. 3. The fluidizable medium which falls down onto the fluid bed 22 after the blasting preferably is constantly picked up through a slot 30, and is delivered by a heat-resistant bucket conveyor 15 to the chamber 6 for cleaning and reheating.

With the apparatus of FIG. 4 it is possible first to preheat in the fluidized bed the objects which are in a basket or individually suspended and thus to carbonize the coating. After removal from the fluidized bed by means of the hoist 28, the blasting operation with the blasting medium heated to the carbonizing temperature begins, while the already carbonized layers are quickly removed. By the use of two hoists, one part of the objects can be held in the fluidized bed for heating while another is being blasted.

The peripheral units used in the present embodiments, such as the air injection blowers and exhaust fans, the units for cleaning and filtering, and the bucket conveyor, are to be considered only as technical possibilities, and they do not represent a limitation of the solutions to the problem. It is especially possible to operate spinners with impeller systems at temperatures of 450° to 500° C. The hot blasting medium then comes in contact with metal parts. The bearings of the spinners should be insulated against the heat so that no direct thermal transfer takes place.

Since the pyrolysis carbon ablated by the blasting medium is very finely granular to powdery, it can easily be separated from the blasting medium in conventional cascade separators and then fed to an afterburner. The pyrolysis gas can also be burned in afterburners and furnaces known in themselves.

The following are examples of the method.

EXAMPLE 1

Stripping of Bulky Hangers (Automobile Painting)

Painting hangers of a length of 0.4 m and covered with old lacquer coating up to 5 mm thick are laid loosely in a sandblasting basket and hung in the blasting portion of a retort in accordance with FIG. 1. The capacity of the retort is around 3 cubic meters (1 square meter on the bottom by 3 meters high). The bottom half of the retort is filled with fluid-bed material. The fluid-bed material and the blasting medium are steel grits with a grain size of 0.2 to 0.4 mm. The blasting medium is heated at 450° C. by injected hot air and is fed at this temperature also by the bucket conveyor into the chamber 6 where it is again heated. The parts are first heated for ten minutes in the fluid bed, then lifted out of the fluid bed and hot-blasted at 450° C. for five minutes with rotation of the basket. The pyrolysis and carbonization gases are exhausted. The parts can be taken out without any residue.

EXAMPLE 2

Removal of Insulation from Copper and Aluminum Cables

Sections of cable 5 to 50 cm long with a metal strand thickness between 8 and 20 mm are piled loosely in a sandblasting basket and blasted in a heated retort with metal grits of 0.2 to 0.5 mm grain size at 500° C. (copper grits for copper cables) in the one case and 380° C. (aluminum grits for aluminum cables) in the other. No fluid bed is provided.

Depending on the thickness and on the kind of insulating material, the treatment takes between 5 and 30 minutes. The length of time can be determined empirically or visually. Fully stripped metal strands are removed from the sandblasting basket.

EXAMPLE 3

Degreasing of Oil-Impregnated Diesel Engine Heads

For the degreasing and complete stripping of extremely dirty cylinder heads, from salvaged boats for example, the heads are treated in a retort in accordance with FIG. 4, in which first they are heated in a fluidized bed of steel grits (0.1 to 0.3 mm grain size) at 260° C. Then the cylinder head is hung up and blasted with the grits while rotating, until the surface is entirely free of residue. The treatment takes a total of about 20 minutes.

EXAMPLE 4

Removal of Plastic or Rubber Residues from Flat Housing Parts

By means of sand heated at 300° to 400° C., flat housing parts bearing residues of plastic or rubber are freed of these residues, including those adhering directly to the metal surfaces.

Layer after layer is pyrolyzed, carbonized and embrittled by the hot sand, so as to be removable. For example, styrofoam linings 15 mm thick on metal parts can be completely removed within 10 minutes. It takes longer in the case of a rubber covering, such as rubber padding vulcanized onto tank treads which calls for about 25 minutes of treatment at a temperature of 450° C.

The above examples 1 to 4 show that the process is suitable for quickly stripping very difficult to remove surface coatings, which are inaccessible to sandblasting, by a combination of pyrolysis and blasting.

The operation can be a batch process or it can be a continuous process for the removal, for example, of noise-damping decompositions from steel pipes.

While there have been described what are at present considered to be the preferred embodiments of this invention, it will be obvious to those skilled in the art that various changes and modifications may be made therein without departing from the invention, and it is, therefore, aimed to cover all such changes and modifications as fall within the true spirit and scope of the invention.

What is claimed is:

1. A method for the removal of carbonizable, adherent coatings from the surfaces of metal objects, in which the coatings on the metal objects are carbonized or pyrolyzed in the course of the method, comprising:

bringing one or more metal objects having one or more carbonizable, adherent coatings on one or more surfaces thereof in a substantially closed retort to the carbonizing temperature; and, heating a blasting medium at least to a temperature so high that the temperature within the retort does not diminish below the temperature required for carbonizing within the retort;

without the one or more metal objects leaving the retort, utilizing the heated blasting medium to blast off the one or more adherent, carbonized coatings at least after the beginning of the carbonization.

2. A method in accordance with claim 1, which includes heating the blasting medium at least to the carbonizing temperature.

3. A method in accordance with claim 1, which includes carrying blasting medium out of the retort for cleaning and heating; and sorting, heating, and returning blasting medium in closed circuit to the blasting medium in the retort.

4. A method in accordance with claim 1, which includes heating the metal objects within the retort in a fluidized bed.

5. A method in accordance with claim 4, which includes utilizing the blasting medium as a bedding medium of the fluidized bed.

6. A method in accordance with claim 1, for the removal of lacquer coatings, which includes heating the blasting medium and the atmosphere of the retort to a temperature between 400° and 460° C.

7. A method in accordance with claim 1, in which the metal objects are conductor cables to be stripped, in which the step of utilizing a heated blasting medium includes utilizing a heated blasting medium of the same metal as the metal cable.

8. A method in accordance with claim 1, in which the step of utilizing a heated blasting medium includes utilizing a heated blasting medium to blast off the one or more adherent, carbonized coatings as the carbonization progresses.

9. A method in accordance with claim 1, in which the step of utilizing a heated blasting medium includes utilizing a heated blasting medium to blast off the one or more adherent, carbonized coatings after the carbonization ends.

* * * * *